US010533771B2

(12) United States Patent
Post

(10) Patent No.: US 10,533,771 B2
(45) Date of Patent: Jan. 14, 2020

(54) BLOWER ASSEMBLY WITH COMPENSATION FOR VENT BACK PRESSURE

(71) Applicant: Regal Beloit America, Inc., Beloit, WI (US)

(72) Inventor: Steven W. Post, Cassville, MO (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 295 days.

(21) Appl. No.: 15/181,598

(22) Filed: Jun. 14, 2016

(65) Prior Publication Data

US 2017/0356675 A1 Dec. 14, 2017

(51) Int. Cl.

| | |
|---|---|
| ***F24H 9/20*** | (2006.01) |
| *F24H 1/24* | (2006.01) |
| *F24H 9/00* | (2006.01) |

(52) U.S. Cl.

CPC ..... *F24H 9/2035* (2013.01); *F24H 1/24* (2013.01); *F24H 9/0031* (2013.01); *F24H 9/2007* (2013.01)

(58) Field of Classification Search

CPC .... F24H 9/2035; F24H 9/2007; F24H 9/0031; F24H 1/24

USPC ..... 122/14.21, 14.1, 13.01

See application file for complete search history.

(56) References Cited

U.S. PATENT DOCUMENTS

| | | | | |
|---|---|---|---|---|
| 4,334,855 A * | 6/1982 | Nelson | F23N 1/065 | 126/116 A |
| 5,197,665 A * | 3/1993 | Jenson | F23N 5/203 | 236/20 R |
| 2008/0029081 A1* | 2/2008 | Gagas | F24C 15/2035 | 126/299 D |
| 2008/0127962 A1* | 6/2008 | Thompson | F23N 5/184 | 126/116 A |
| 2016/0076768 A1* | 3/2016 | Kusachi | F23N 1/042 | 431/12 |

* cited by examiner

*Primary Examiner* — Steven B McAllister
*Assistant Examiner* — Benjamin W Johnson
(74) *Attorney, Agent, or Firm* — Thompson Coburn LLP

(57) ABSTRACT

A blower assembly is configured for use with a gas-operated heater having a burner and an exhaust port. The blower assembly has a blower and a sensor. The blower is configured to operate at two or more speeds and is configured to operatively connect to the burner in a manner to facilitate flow of combustion air into the burner and to facilitate flow of exhaust through the exhaust port. The sensor is configured to be sensitive to pressure of exhaust downstream of the blower. The sensor is operatively connected to the blower in a manner such that the blower will change speeds if said pressure exceeds a threshold pressure.

17 Claims, 4 Drawing Sheets

BLOWER ASSEMBLY WITH COMPENSATION FOR VENT BACK PRESSURE

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

The present invention pertains to blower assemblies for use with heaters having burners.

General Background

Heat exchangers comprising a burner, such as gas-fueled water heaters or HVAC heaters, typically comprise a blower motor assembly that provides combustion air to the burner (often via induction). The blower motor assembly ensures that the burner has sufficient oxygen to completely combust the fuel and also ensures that the reaction products from combustion are exhausted from the heat exchanger. If insufficient combustion air is supplied to the burner, excessive carbon monoxide is formed (which can result in carbon monoxide poisoning and is detrimental to the atmosphere). However, if the combustion air flow is excessive (i.e., higher than is needed to completely combust the gas fuel), the heated combustion reaction products pass through the heat exchanger faster than is needed, resulting in unnecessarily low efficiency due to higher exhaust temperatures and therefore less heat exchange per fuel burned. Unfortunately, the vent lines connected to the exhaust port of heat exchangers vary in length, size, and complexity as dictated by the location of such heat exchangers within a building or structure and the need to vent the combustion reaction products to the environment external to the building or structure. As such, the back pressures caused by the exhaust gas flow through different vent lines also vary. The back pressure caused by a given vent line impacts how quickly combustion air and reaction products flow through a heat exchanger using a given blower and blower speed. Thus, the installation and operational specifications associated with most gas-fueled heat exchangers or the blower assemblies associated therewith typically dictate an allowable range of exhaust vent line length for the given heat exchanger and blower combination. The output of the blower assembly is therefore configured to provide adequate combustion air for the longest permitted vent line length (maximum back pressure situation). Unfortunately, this means that when the given heat exchanger and blower assembly combination is attached to the shortest permitted vent line length, the combustion air flow is excessive and, as mentioned above, the efficiency of the system will be reduced.

Options to resolve the above-mentioned problem include customizing the blower output for a particular heat exchanger installation or providing a multispeed blower that can be set by a technician for a particular output for the particular heat exchanger installation. However, both options would be costly and the latter would also be risky.

SUMMARY OF THE INVENTION

The present invention solves the problems mentioned above by providing a multi-speed blower motor and a control system assembly for a draft inducer blower, preferably housed together, that automatically sets the speed of the blower motor in response to the flow rate of the exhaust output in the vent line downstream of the blower. Preferably, the control system achieves this via a pressure sensor located in a blower housing that is connected to a pressure tap (in the housing or downstream thereof) that is sensitive to/indicative of the exhaust output in the vent line downstream of the blower.

One aspect of the invention pertains to a draft inducer blower assembly for use with a gas-operated heater having a burner and a combustion exhaust port. The blower assembly comprises a blower and a sensor. The blower is configured and adapted to operate at least at a lower speed and a higher speed. The blower is also configured to operatively connect to the heater in a manner to facilitate flow of combustion air into the burner and to facilitate flow of exhaust through the combustion exhaust port. The sensor is configured to be sensitive to pressure of the exhaust downstream of the blower. The sensor is operatively connected to the blower in a manner such that the blower will switch from the lower speed to the higher speed if said pressure exceeds a threshold pressure.

In another aspect of the invention, a heat exchanger assembly comprises a burner, a blower, a combustion exhaust port, and a sensor. The blower is configured and adapted to operate at two or more speeds. The blower is operatively connected to the burner in a manner such that the blower can supply combustion air to the burner and such that exhaust can be vented from the heat exchanger via the exhaust port. The sensor is sensitive to the pressure of exhaust downstream of the blower. The sensor is operatively connected to the blower in a manner such that the blower will change speeds if said pressure exceeds a threshold pressure.

In yet another aspect of the invention, a water heater assembly comprises a water vessel, a burner, a blower, a combustion exhaust port, and a sensor. The blower is configured and adapted to operate at two or more speeds and is connected to the burner in a manner such that the blower can supply combustion air to the burner and such that exhaust can be vented from the water heater via the exhaust port. The water vessel is configured to hold water heated by the burner. The sensor is sensitive to the pressure of exhaust downstream of the blower. The sensor is operatively connected to the blower in a manner such that the blower will change speeds if said pressure exceeds a threshold pressure.

In still another aspect of the invention, a blower assembly is configured for use with a gas-fueled heater having a burner and an exhaust port. The blower assembly comprises a blower and a sensor. The blower is configured and adapted to operate at two or more speeds and is configured to operatively connect to the burner in a manner to facilitate flow of combustion air into the burner and to facilitate flow of exhaust through the exhaust port. The sensor is configured to be sensitive to pressure of exhaust downstream of the blower. The sensor is operatively connected to the blower in a manner such that the blower will change speeds if said pressure exceeds a threshold pressure.

In yet another aspect of the invention, a blower assembly is configured for use with a gas-fueled water heater having a water vessel and a heat exchanger assembly comprising a burner and an exhaust port. The blower assembly comprises a blower and a sensor. The blower is configured and adapted to operate at two or more speeds and is configured to operatively connect to the burner in a manner to facilitate flow of combustion air into the burner and to facilitate flow of exhaust through the exhaust port. The sensor is configured to be sensitive to pressure of exhaust downstream of the blower. The sensor is operatively connected to the blower in a manner such that the blower will change speeds if said pressure exceeds a threshold pressure.

Further features and advantages of the present invention, as well as the operation of the invention, are described in detail below with reference to the accompanying drawings.

Figure 1:
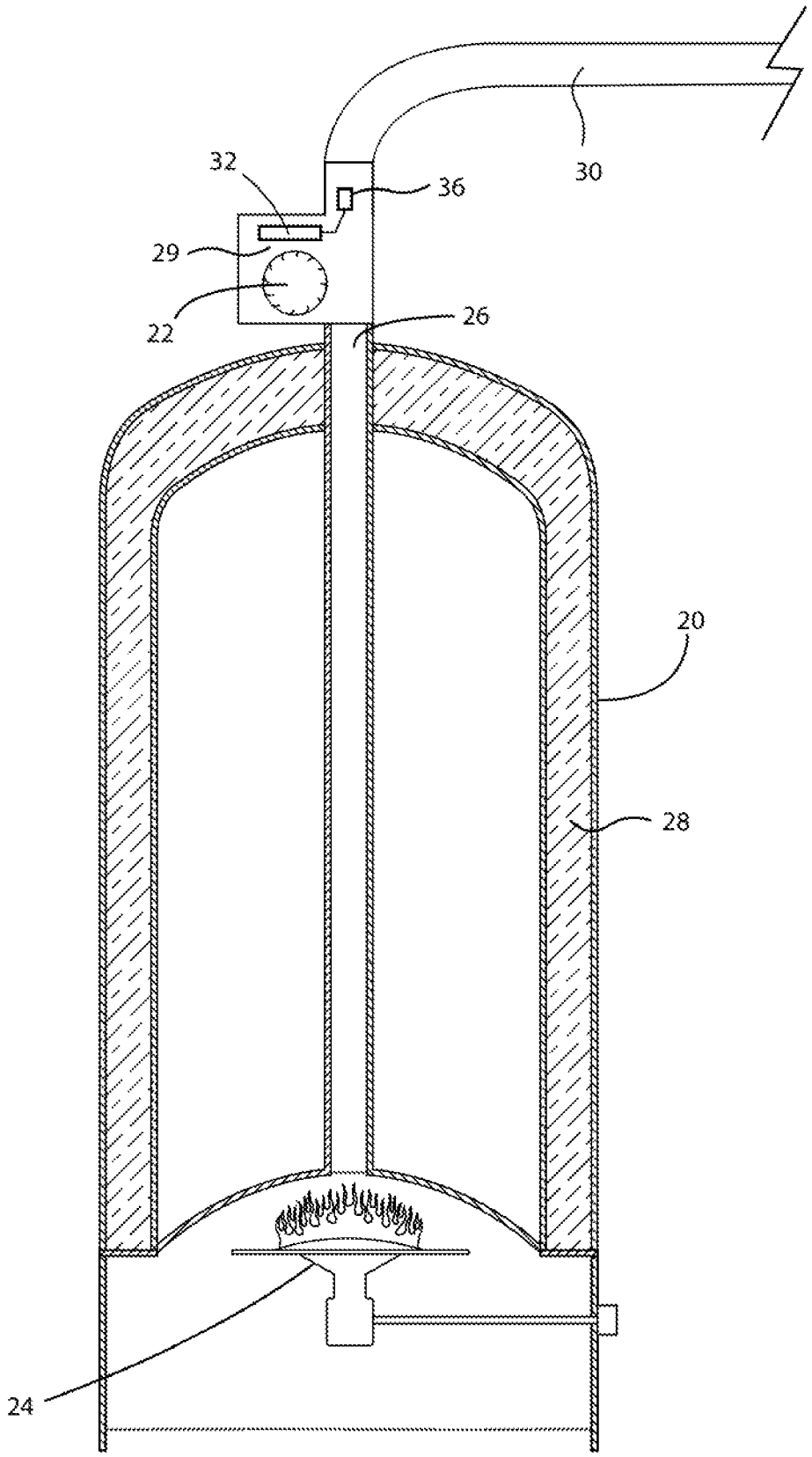
FIG. 1 depicts a schematic of a water heater.

Reference numerals in the written specification and in the drawing figures indicate corresponding items.

DETAILED DESCRIPTION

FIG. 1 schematically depicts a gas-fueled water heater (20). Like a typical gas-fueled heat exchanger, the water heater comprises a blower motor (22), a burner (24), and an exhaust port (26). Being a water heater, the water heater (20) also comprises a water vessel (28) which stores water that is heated by the exhaust of the burner (24). The blower motor (22) is operatively connected to the burner for causing combustion air to flow through the burner (24) and for causing exhaust caused by combustion to flow out of the water heater (20) through the exhaust port (26). The exhaust port (26) is connected, often via a housing (29) that contains the entire blower assembly rather than directly, to an exhaust vent line (30) that channels the combustion reaction products out of the structure or building in which the water heater is located. Nonetheless, the entire blower assembly needs not be contained within a housing.

Figure 2:
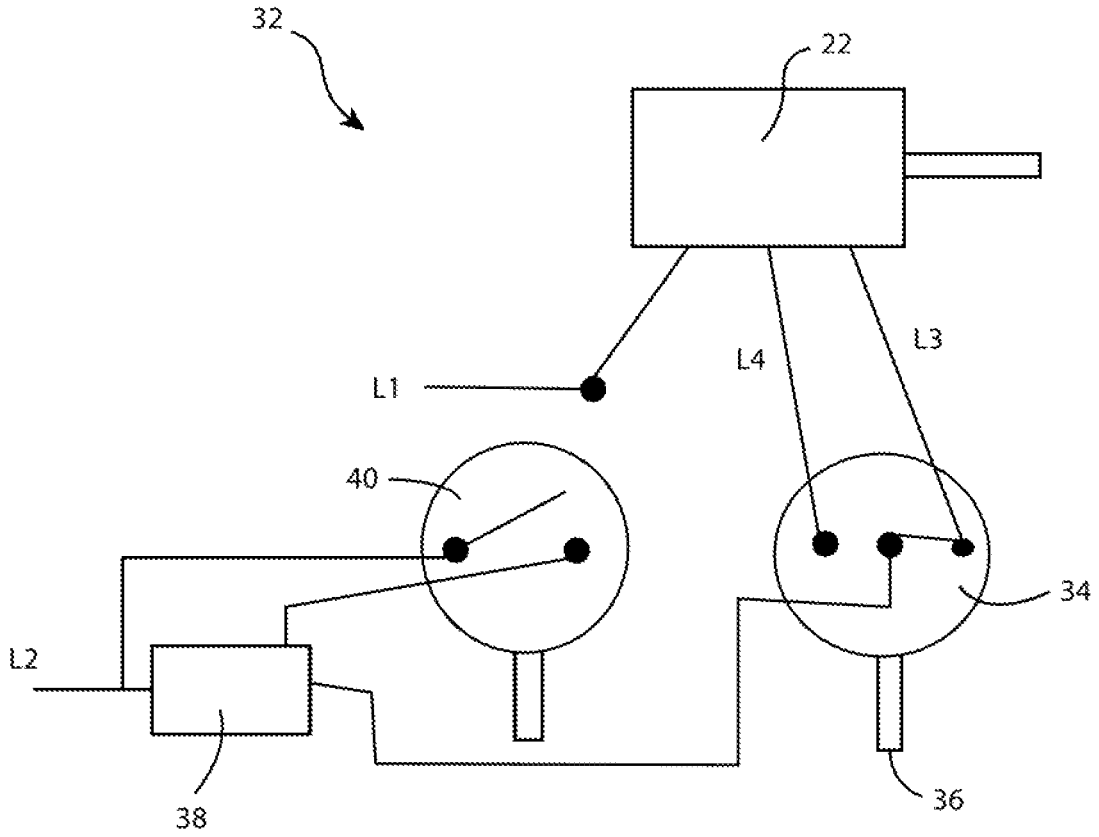
FIG. 2 depicts a schematic of an embodiment of a blower motor control system in accordance with the invention.

An embodiment of a control system (32) in accordance with the invention for operating the blower motor (22) is shown in FIG. 2. Preferably the entire control system (32) is contained in a single housing (29) as a blower assembly. As shown, the blower motor is connected to an electrical ground line (L1) and is also connected to a pressure switch (34). The pressure switch (34) is operated by a pressure sensor (36) that detects pressure downstream of the blower motor (22).

In this embodiment of the invention, the pressure switch (34) is a single-pole double-throw switch. During operation, electrical power is supplied to the pressure switch (34) by a controller (38). The controller (38) is also connected to a vacuum switch (40) that is upstream of the blower (22) or is communicating with a zone within the blower where the vacuum reading is indicative of whether the burner has adequate flow to support combustion without excessive carbon monoxide.

When the heater (20) is initially activated, the controller (38), which is connected to an electrical source (L2), initially sends power to the pressure switch (34). The pressure switch (34) initially sends power to a lead (L3) on the blower motor (22) that operates the blower at a low speed. The pressure switch will then continue to send that power to the lead (L3) on the blower motor (22) that operates the blower at a low speed, unless the pressure sensor (36) detects pressure at or above a threshold pressure indicative of pressure downstream of the blower (22) (which is indicative of high back pressure in the exhaust vent line (30)). Upon detecting pressure at or above the threshold pressure, the pressure switch (34) will switch power to a lead (L4) on the blower motor (22) that operates the blower at a high speed. Upon operating a higher speed, the sensed pressure will be even greater. This prevents the blower motor (22) from short cycling between speeds. Assuming a sufficient vacuum is being drawn upstream of the blower, the vacuum switch (40) will have been triggered and the controller (38) will activate the igniter and fuel gas valve and will continue to send power to the pressure switch (34). However, if, after a brief delay, the vacuum switch (40) is not triggered by a sufficient drop in pressure upstream of the blower's (22) fan output, the controller (38) will not activate the igniter and fuel gas valve (not shown) of the burner (24) and will discontinue supplying power to the pressure switch (34).

It should be understood that the pressure tap for the pressure sensor (36) could be located at any location where the pressure measurement can be correlated to the back pressure and flow output through the exhaust vent line (30). Thus, the pressure sensed by the pressure sensor (36) needs not necessarily be an actual pressure measurement of pressure downstream of the blower assembly. For example, the pressure tap of the pressure sensor could be adjacent a fan of a blower, in a discharge passage of a blower housing, or in the exhaust vent line itself.

Figure 3:
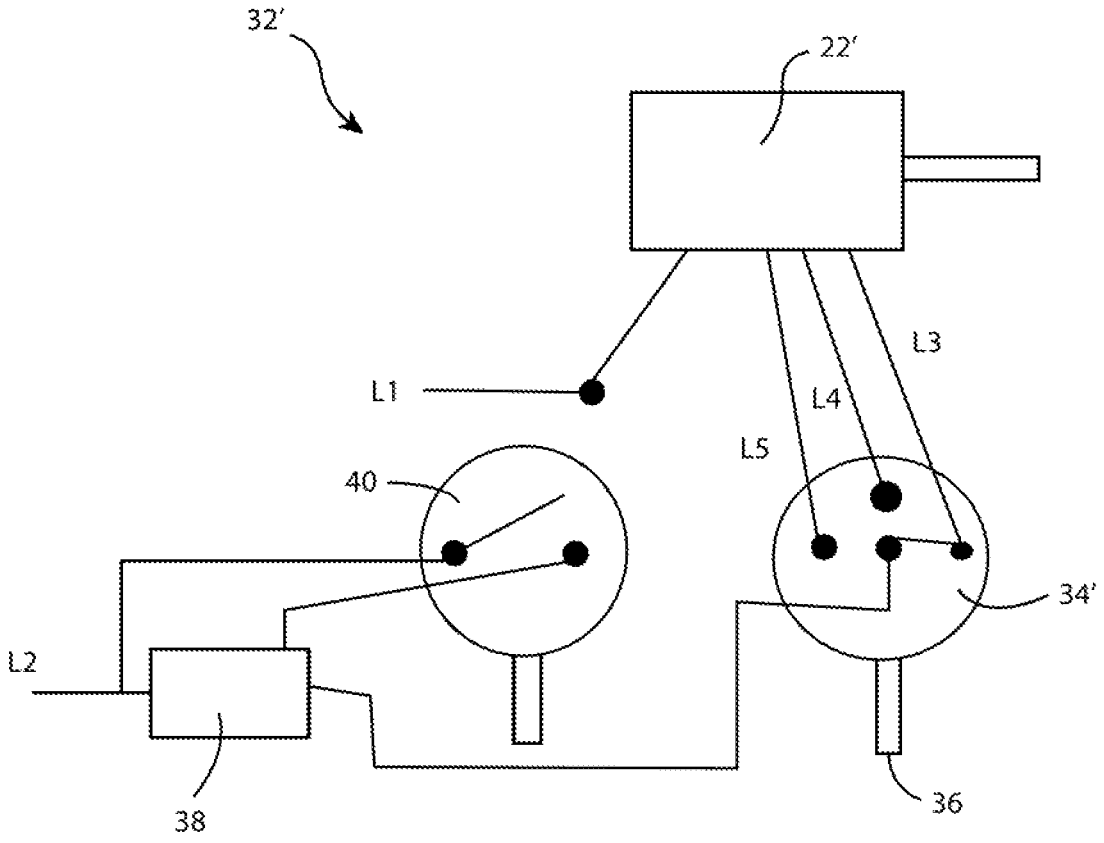
FIG. 3 depicts a schematic of another embodiment of a blower motor control system in accordance with the invention.

Another embodiment of a control system (32') in accordance with the invention for operating the blower motor (22') is shown in FIG. 3. This control system (32') is very similar to the control system (32) shown in FIG. 2. However, as shown in FIG. 3, the pressure switch (34') is a triple-throw switch and the blower motor (22') is configured with a third speed lead (L5). Thus the pressure switch (34') is responsive to two different threshold pressures for potentially operating the blower motor (22') at three different speeds (e.g., low, medium, and high). The control system (32') otherwise operates in the same manner as the control system (32) shown in FIG. 2.

Figure 4:
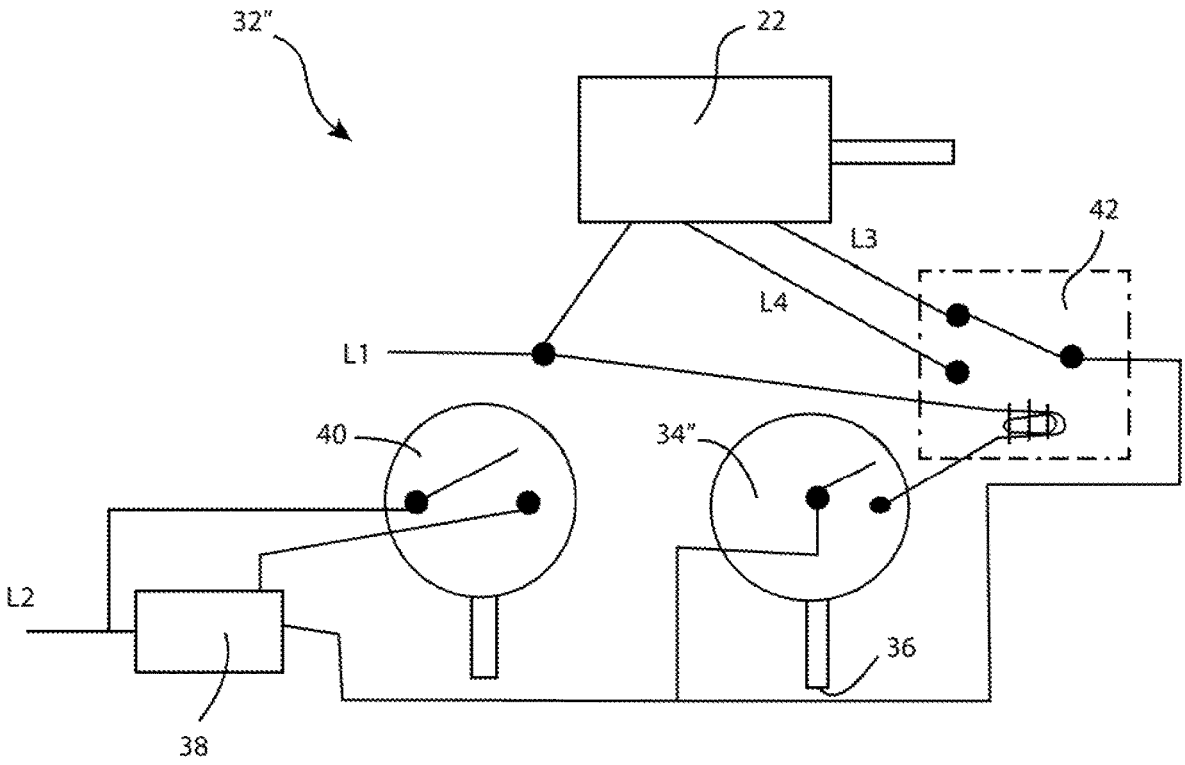
FIG. 4 depicts a schematic of yet another embodiment of a blower motor control system in accordance with the invention.

Yet another embodiment of a control system (32") in accordance with the invention for operating the blower motor (22) is shown in FIG. 4. Again, this control system (32") is very similar to the control system (32) shown in FIG. 2. However, with this control system (32"), the pressure switch (34") is a single-pole single-throw switch that is connected to a relay device (42). As shown, the relay device (42) operates a single-pole double-throw switch that is supplied with power directly from the controller (38). When the pressure sensor (36) detects a pressure at or above the threshold pressure, the pressure switch (34") closes and thereby sends power to the relay device (42), which then switches to divert the power delivered to the single-pole double-throw switch of the relay device (42) from being delivered to the low speed lead (L3) of the blower motor (22) to being delivered to the high speed lead (L4) of the blower motor. This embodiment of the control system (32") is suited for high power blower motors and avoids running high amperage through any pressure switch.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

What is claimed is:

1. A draft inducer blower assembly for use with a gas-fueled heater having a burner and an exhaust port, the blower assembly comprising: a blower, a sensor, and a multiple-throw switch switchable between at least first and second positions, the blower being configured and adapted to operate at a lower speed when the switch is in the first position and to operate at a higher speed when the switch is in the second position, the blower being configured to operatively connect to a heater to impel flow of combustion air into a burner and to impel flow of exhaust through an exhaust port, the sensor being configured to be sensitive to pressure of the exhaust downstream of the blower, the sensor being operatively connected to the switch in a manner such that the switch will switch from the first position to the second position if pressure sensed by the sensor exceeds a threshold pressure.

2. The draft inducer blower assembly in accordance with claim 1 wherein the blower is configured to operate at only the lower speed and the higher speed.

3. The draft inducer blower assembly in accordance with claim 1 wherein the blower is configured to operate at only the lower speed, the higher speed and a medium speed between the lower speed and the higher speed.

4. The draft inducer blower assembly in accordance with claim 1 wherein the draft inducer blower assembly is an induction blower motor assembly.

5. The draft-inducer blower assembly in accordance with claim 1, wherein the multiple-throw switch a single-pole multiple-throw switch.

6. A heat exchanger assembly comprising a burner, a blower, an exhaust port, a sensor, and a multiple-throw switch switchable between at least first and second positions, the blower being configured and adapted to operate at a first speed when the multiple-throw switch is in the first position and to operate at a second speed when the multiple-throw switch is in the second position, the second speed being higher than the first speed, the blower being connected to the burner and configured to supply combustion air to the burner and vent exhaust via the exhaust port, the sensor being sensitive to a pressure of the exhaust downstream of the blower, and the sensor being operatively connected to the multiple-throw switch in a manner such that the multiple-throw switch will switch from the first position to the second position if pressure sensed by the sensor exceeds a threshold pressure.

7. The heat exchanger assembly in accordance with claim 6 wherein the exhaust port is configured and adapted to be operatively connected to different vent lines having different back pressures resulting from gaseous flow therethrough, and pressure of the exhaust downstream of the blower is dependent upon said back pressures.

8. The heat exchanger assembly in accordance with claim 7 wherein the heat exchanger assembly is a water heater that comprises a water vessel that is configured to hold water heated by combustion products.

9. The heat exchanger assembly in accordance with claim 6 wherein the multiple-throw switch a double-throw switch.

10. The heat exchanger assembly in accordance with claim 6 wherein the multiple-throw switch is a triple-throw switch switchable between the first position, the second position, and a third position, wherein the blower is configured and adapted to operate at a third speed higher than the second speed when the triple-throw switch is in the third position wherein the threshold pressure is a first threshold pressure, and wherein the sensor is configured to trigger the triple-throw switch to switch from the first position to the second position when the first threshold pressure is detected by the sensor and to trigger the triple-throw switch to switch from the second position to the third position when second, higher threshold pressure is detected by the sensor.

11. The heat exchanger assembly in accordance with claim 6, further comprising a relay device and a single-pole single-throw switch, wherein the multiple-throw switch is a single-pole double-throw switch, the sensor is operatively connected to the single-pole single-throw switch to trigger the single-pole single-throw switch to close when said pressure sensed by the sensor exceeds the threshold pressure, the single-pole single-throw switch is operatively connected to the relay device to transmit a charge to the relay device when closed, and the relay device is configured to switch the single-pole double-throw switch from the first position to the second position upon receiving the charge transmitted from the closed single-pole single-throw switch.

12. The heat exchanger assembly in accordance with claim 11 wherein the relay device is uncharged unless the sensor detects that the threshold pressure has been exceeded.

13. The heat exchanger assembly in accordance with claim 6, wherein the multiple-throw switch a single-pole multiple-throw switch.

14. A water heater assembly comprising a water vessel, a burner, a blower, an exhaust port, a sensor, and a multiple-throw switch switchable between at least first and second positions, the blower being configured and adapted to operate at a first speed when the switch is in the first position and to operate at a second speed when the switch is in the second position, the second speed being higher than the first speed, the blower being connected to the burner and configured to supply combustion air to the burner and impel exhaust via the exhaust port, the water vessel being configured to hold water heated by reaction products from combustion, the sensor being sensitive to pressure of the exhaust downstream of the blower, and the sensor being operatively connected to the switch in a manner such that the switch will switch from the first position to the second position if pressure sensed by the sensor exceeds a threshold pressure.

15. The water heater assembly of claim 14, wherein the multiple-throw switch a single-pole multiple-throw switch.

16. A blower assembly for use with a gas-operated water heater having a water vessel and a heat exchanger assembly comprising a burner and an exhaust port, the blower assembly comprising a blower, a sensor, and a multiple-throw switch switchable between at least first and second positions, the blower being configured and adapted to operate at a first speed when the switch is in the first position and to operate at a second speed when the switch is in the second position, the second speed being higher than the first speed, the blower being configured to operatively connect to a burner to impel flow of combustion air into the burner and to facilitate flow of exhaust through an exhaust port, the sensor being configured to be sensitive to pressure of the exhaust downstream of the blower, and the sensor being operatively connected to the switch in a manner such that the switch will switch from the first position to the second position if pressure sensed by the sensor exceeds a threshold pressure.

17. The blower assembly of claim 16, wherein the multiple-throw switch a single-pole multiple-throw switch.

* * * * *